United States Patent [19]

Ikeda

[11] Patent Number: 4,928,364

[45] Date of Patent: May 29, 1990

[54] BUCKLE

[75] Inventor: Yasuhiko Ikeda, Toyonaka, Japan

[73] Assignee: NIFCO, Inc., Yokohama, Japan

[21] Appl. No.: 368,758

[22] Filed: Jun. 20, 1989

[30] Foreign Application Priority Data

Jun. 22, 1988 [JP] Japan ..... 63-82767[U]

[51] Int. Cl.[5] ..... A44B 11/25

[52] U.S. Cl. ..... 24/614; 24/171; 24/615

[58] Field of Search ..... 24/614, 615, 662, 683, 24/604, 308, 316, 171, 194

[56] References Cited

U.S. PATENT DOCUMENTS

| | | | |
|---|---|---|---|
| 4,035,877 | 7/1977 | Brownson et al. | 24/171 |
| 4,398,324 | 8/1983 | Bakker et al. | 24/615 |
| 4,569,106 | 2/1986 | Lovato | 24/615 |
| 4,679,282 | 7/1987 | Feng | 24/614 |

FOREIGN PATENT DOCUMENTS 145602 6/1988 Japan .

*Primary Examiner*—Victor N. Sakran
*Attorney, Agent, or Firm*—Schwartz & Weinrieb

[57] ABSTRACT

A buckle includes a first buckle body and a second buckle body. The first buckle body is inserted into the second buckle body so s to be made incapable of withdrawl from the second buckle body and is released from engagement with and made capable of withdrawl from the second buckle body by inserting it further into the second buckle body from its engaged state. The second buckle body is integrally provided with flexing portions which are formed so as to face the free end of the first buckle body when the same is engaged with the second buckle body. The flexing portions extend in a direction substantially perpendicular to the insertion direction of the first buckle body, can elastically flex in the insertion direction of the first buckle body, serve to restrict the insertion of the first buckle body into the second buckle body, thereby locating the first buckle body at a position of engagement with the second buckle body, and are flexed so as to locate the first buckle body at a position of disengagement with respect to the second buckle body.

6 Claims, 4 Drawing Sheets

BUCKLE

FIELD OF THE INVENTION

This invention relates to a buckle used for coupling straps together upon suspenders for ski pants.

DESCRITPION OF THE PRIOR ART

This type of buckle comprises a pair of buckle bodies capable of being coupled to each other. When this buckle is used for coupling suspenders to ski pants, for example, one of the two of buckle bodies is attached to the ski pants, while the other one is attached to an end of the suspenders. The two buckle bodies are then coupled together so as to couple the suspenders to the ski pants. In this kind of buckle, the two buckle bodies are disconnecting by withdrawing one of the bodies while pushing a disconnected section provided upon the other body. This disconnecting operation is rather cumbersome.

To overcome this drawback, a buckle is proposed in Japanese Patent Public Disclosure SHO No. 63-145602, in which two buckle bodies can be disconnected by inserting the inserted one of the two buckle bodies still further into the other buckle body, whereafter the inserted buckle body can be withdrawn from the other buckle body without the possibility of reconnecting the two buckle bodies.

FIG. 8 shows a buckle having this construction. In this buckle, the extent of insertion of a first buckle body 10 into a second buckle body 12 is suitably limited. In the buckle shown in FIG. 8, a block 16 is provided with a spring 14 within the second buckle body 12, and the extent of insertion of the first buckle body 10 is limited by means of the biasing force of the spring 14.

The first buckle body 10 is engaged with the second buckle body 12 with an end thereof in engagement with the block 16 while compressing the spring 14 by inserting it into the second buckle body 12. The biasing force of the spring 14 is such that the buckle body 10 is not inserted to a depth beyond the engaged position with a predetermined inserting force. In order to disconnect the two buckle bodies, the first buckle body 10 is inserted into the second buckle body still further against the biasing force of the spring 14 and with an insertion force which is greater than the predetermined force so as to move the block 16 to a greater depth within the second buckle body 12, and is then pulled out of the second buckle body 12.

In this prior art buckle, the block 16 and spring 14 are required to be separate parts, thus increasing both the number of components and the cost. In addition, the provision of the spring 14 results in a corresponding increase in the longitudinal dimension of the second buckle body 12 in the directions of insertion and withdrawal of the first buckle body 10 (that is, to the left and right in FIG. 8), and hence an overall increase in the buckle size.

OBJECT OF THE INVENTION

An object of the invention is to provide a buckle which has a simple construction and permits size reduction of two buckle bodies of substantially the same size.

SUMMARY OF THE INVENTION

According to the invention, there is provided a buckle, which comprises a first buckle body and a second buckle body, the first buckle body being made incapable of withdrawal from the second buckle body when inserted into the second buckle body, the first buckle body being released from engagement with the second buckle body and made capable of withdrawal from the second buckle body without re-engagement with the second buckle body by inserting it further into the second buckle body from its state of engagement with the second buckle body, the second buckle body having integral flexing portions formed, upon a portion facing the free end of the first buckle body in the direction of insertion and during the state of engagement with the first buckle body, extending in a direction substantially perpendicular to the direction of insertion and withdrawal of the first buckle body and capable of elastically flexing during insertion of the first buckle body, the flexing portions serving to restrict insertion of the first buckle body so as to locate the first buckle body at a predetermined position of engagement with the second buckle body and being flexed capable of being flexed so as to locate the first buckle body at a position of disengagement with respect to the second buckle body.

With the above construction of the buckle according to the invention, the flexing portions restrict the extent of insertion of the first buckle body into the second buckle body so as to permit reliable engagement of the first buckle body with the second buckle body. Also, from this state of engagement, the flexing portions so as are flexed to permit further insertion of the first buckle body into the second buckle body so that the first buckle body is disengaged from the second buckle body and can be withdrawn from the second buckle body without the possibility of re-engagement with the second buckle body.

The flexing portions are formed integrally with the second buckle body and extend in a direction substantially perpendicular to the direction of insertion and withdrawal of the first buckle body. Thus, no separate component with respect to the two buckle bodies is necessary, and also the size of the second buckle body can be reduced in the direction of insertion and withdrawal of the first buckle body.

BRIEF DESCRIPTION OF THE DRAWINGS

The above and other objects and features of the invention will become more apparent from the following detailed description with reference to the accompanying drawings, in which like or corresponding parts have been designated by the same reference characters throughout the several views, and wherein.

DETAILED DESCRIPTION OF THE PREFERRED EMBODIMENT

Figure 1:
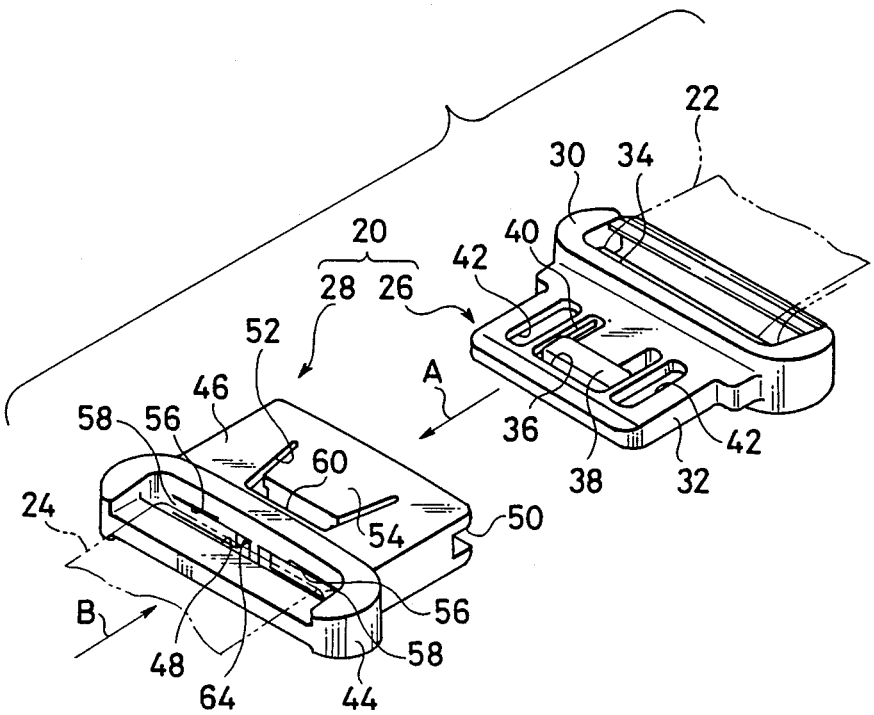
FIG. 1 is a perspective view showing one embodiment of the buckle according to the invention, with two buckle bodies disconnected from each other.
Figure 2:
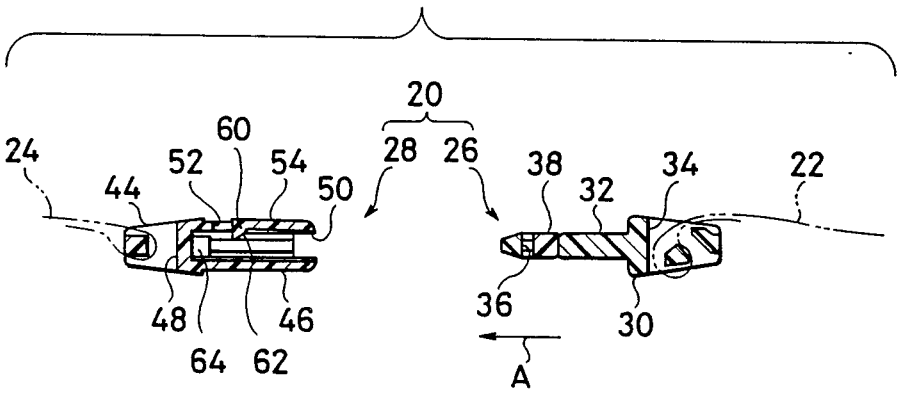
FIG. 2 is a sectional view showing the two buckle bodies of the buckle shown in FIG. 1 in the disconnected state.
Figure 3:
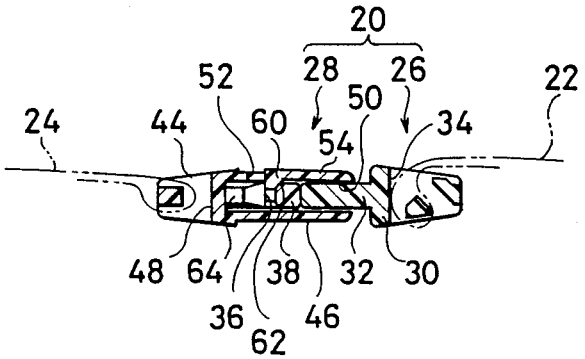
FIG. 3 is a sectional view showing the two buckle bodies of the buckle shown in FIG. 1 in the coupled state.

FIGS. 1 to 7 show one embodiment of the buckle according to the invention. This embodiment of the buckle, which is denoted by the reference numeral 20, is used to couple together belts 22 and 24. As shown in FIG. 3, the belts 22 and 24 can be coupled together by coupling together first and second buckle bodies 26 and 28. As shown in FIGS. 1 and 2, the belts 22 and 24 can be separated from each other by separating the first and second buckle bodies 26 and 28. These first and second buckle bodies 26 and 28 are plastic moldings.

As shown in FIGS. 1 and 2, the first buckle body 26 has a mounting portion 30 to which the belt 22 is attached, and an inserting portion 32 which is to be inserted into the second buckle body 28.

The mounting portion 30 has a belt insertion hole 34, through which an end portion of the belt 22 is inserted so as to attach the belt 22.

The inserting portion 32 is inserted by means of its free end into the second buckle body 28. The inserting portion 32 has a rectangular hole 36 in which a block 38 is accommodated for movement in the direction of insertion into the second buckle body 28, that is, in the direction of arrow A in FIGS. 1 and 2. More specifically, as shown in FIG. 1, the inner edges of the hole 36 are formed with a pair of guide projections 40 extending in the direction of insertion into the second buckle body 28, that is, in the direction of arrow A in FIGS. 1 and 2 and facing each other. These guide projections 40 are disposed within guide grooves (not shown) formed within the block 38. Thus, the block 38 can be guided by means of the guide projections 40 as it is moved in the direction noted above.

As shown in FIGS. 1 and 2, the second buckle body 28 has a mounting portion 44 to which the belt 24 is attached, and a receiving portion 46 for receiving the inserting portion 32 of the first buckle body 26.

The mounting portion 44 has a belt insertion hole 48 through which an end portion of the belt 24 is passed so as to attach the belt 24 thereto.

The receiving portion 46 is a hollow, flat and substantially rectangular portion, and its end opposite the mounting portion 44 is provided with an opening 50 communicating with an inner space thereof. The inserting portion 32 of the first buckle body 26 is inserted through the opening 50 into a buckle body insertion path region 51 defined by within the inner space of the receiving portion 46 (see FIG. 7). An intermediate portion of the second buckle body 28 has a U-shaped slit 52 defining a hook 54.

The hook 54 is in the form of a cantilever extending in the direction of insertion of the first buckle body 26, that is, in the direction of arrow A in FIGS. 1 and 2), and its free end is provided with a pawl 60 projecting downwardly into the buckle body insertion path region 51. The pawl 60 has an inclined surface 62 facing the opening 50. Upon insertion of the first buckle body 26 into the second buckle body 28, the end of the inserting portion 32 of the first buckle body 26 strikes the inclined surface 62 and moves it so as to cause the hook 54 to elastically deform toward the outer side of the receiving portion 46 so that the pawl 60 can subsequently cooperate with the hole 36 of the first buckle body 26.

Figure 7:
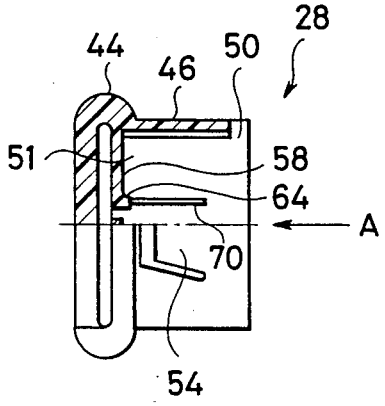
FIG. 7 is a plan view in one half and a sectional view in the other, showing the second buckle body.
Figure 8:
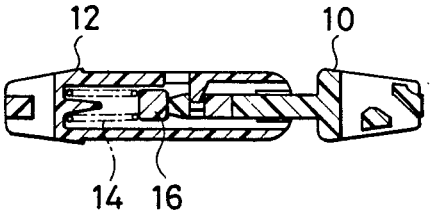
FIG.8 PRIOR ART
FIG. 8 is a sectional view showing a prior art buckle in the coupled state.

The end of the receiving portion 46 opposite the opening 50 is formed with a U-shaped slit 56 so as to define a pair of flexing portions 58 (FIG. 1). As shown in FIG. 7, each of the flexing portions 58 is in the form of a cantilever extending substantially at right angles to the direction of insertion of the first buckle body 26. The free end of each portion 58 is formed with a projection 64 projecting into the buckle body insertion region or path 51. The projections 64 are adapted such that when the pawl 60 of the hook 54 is disposed opposite the hole 36 of the first buckle body 26 and is slightly spaced apart from the end of the inserting portion 32 of the first buckle body 26, the first buckle body 26 cannot be inserted further into the second buckle body 28 by means of a force which is less than a predetermined inserting force.

The flexing portions 58 are adapted such that when the first buckle body 26 is strongly pushed by means of an inserting force exceeding the predetermined force, they are urged by means of the projections 64 so as to be flexed toward the rear end of the receiving portion 46, that is, in the direction of arrow A in FIG. 1, thus permitting further insertion of the first buckle body 26 into second buckle body 28.

Figure 6:
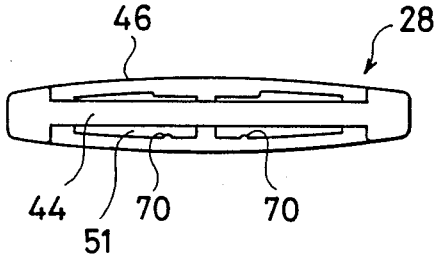
FIG. 6 is a side view taken in the direction of arrow B in FIG. 1 showing the second buckle body.

As shown in FIG. 6, which shows a view in the direction of arrow B in FIG. 1, the second buckle body 28 has its receiving portion 46 formed with small projections 70. As shown in FIG. 7, the small projections 70 project into the buckle body insertion path 51 of the second buckle body 28 and extend in the direction of insertion of the first buckle body 26, that is, in the direction of arrow A in FIGS. 1 and 2. They serve to reduce frictional resistance with the first buckle body 26 at the time of insertion of the first buckle body 26 and prevent rattling of the block 38 within the first buckle body 26.

The operation of the embodiment will now be described.

In order to couple together the belts 22 and 24 by coupling together the first and second buckle bodies 26 and 28, the inserting portion 32 of the first buckle body 26 is inserted through the opening 50 of the second buckle body 28 into the buckle body insertion region 51 formed within in the receiving portion 46 of the second buckle body 28. Within the buckle body insertion region 51, the inserting portion 32 of the first buckle body 26 strikes the end of the inclined surface 62 of the hook 54 of the second buckle body 28 and is then inserted further while causing elastic deformation of the hook 54 toward the outer side of the receiving portion 46 until the pawl 60 faces the hole 36. As soon as the pawl 60 faces the hole 36, the inclined surface 62 engages the block 38 and regains its original position while causing the block 38 to be moved in the direction opposite to the direction of insertion, that is, in the direction opposite to the direction of arrow A in FIGS. 1 and 2, thus entering the hole 36 (see FIG. 3).

At the instant when the pawl 60 occupies the hole 36, the free end of the inserting portion 32 of the first buckle body 26 faces and is slightly spaced apart from the projection 64. Thus, when the first buckle body 26 is inserted still further into the second buckle body 28 after the pawl 60 occupies the hole 36, the free end of the inserting portion 32 engages the projection 64. In order to further insert the first buckle body 26 into the second buckle body 28 from this position of engagement with the projection 64, it is necessary to apply an inserting force which can cause flexing of the flexing portions 58, so that the necessary inserting force is quickly increased. For this reason, it is possible to reliably prevent insertion of the first buckle body 26 into second buckle body 28 beyond a predetermined position even though the user may try to do so.

With the hole 36 occupied by means of the pawl 60, as shown in FIG. 3, the pawl 60 engages the inner edge of the hole 36 so as to prevent withdrawal of the first buckle body 26 out of second buckle body 28. In this way, the first and second buckle bodies 26 and 28 are coupled together so as to couple together the belts 22 and 24.

Figure 4:
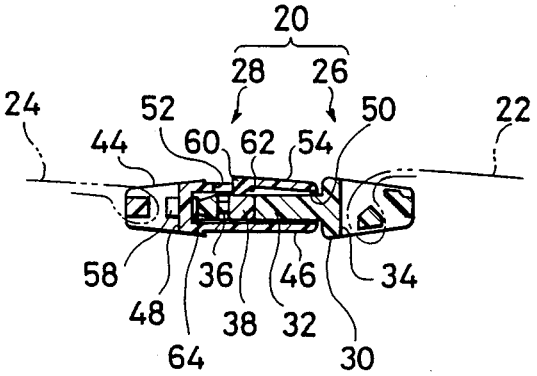
FIG. 4 is a sectional view showing the buckle shown in FIG. 1 in a state which is obtained by pushing one of the two buckle bodies into the other from the coupled state shown in FIG. 3.

In order to separate the belts 22 and 24 by separating the first and second buckle bodies 26 and 28, the first buckle body 26 is strongly pushed into the second buckle body 28 from the state of engagement shown in FIG. 3. As a result, the first buckle body 26 engages the projections 64 so as to cause flexing of the flexing portions 58 as the first buckle body 26 is inserted further into the buckle inserted region 51. In accordance with this insertion operation, the first buckle body 26 causes the block 38 to bias the inclined surface 62 of the pawl 60 away from path 51 so as to cause elastic deformation of the hook 54, thus causing the pawl 60 to be moved toward the outer side of the receiving portion 46 and ride upon the block 38, as shown in FIG. 4.

Figure 5:
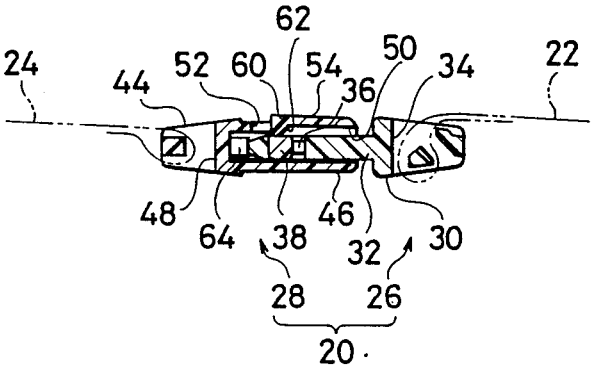
FIG. 5 is a sectional view showing the buckle shown in FIG. 1 in which the two buckle bodies have been pulled in the separating direction from the state shown in FIG. 4.

When the first buckle body 26 is withdrawn from the second buckle body 28, the block 38 is moved relative to the inserting portion 32, being withdrawn from the second buckle body 28, by means of developed frictional force developed with the pawl 60, as shown in FIG. 5. When the first buckle body 26 is withdrawn further, the pawl 60 is transferred from the block 38 to the inserting portion 32. Thus, the pawl 60 will not enter the hole 36 again, so that the inserting portion 32 is withdrawn from second buckle body 28 through the opening 50, thus separating the first and second buckle bodies 26 and 28 so as to separate the belts 22 and 24, as shown in FIG. 2.

As has been shown, in this embodiment the second buckle body 28 is formed with the integral flexing portions 58 so as to restrict the extent of insertion of the first buckle body 26. Thus, no separate spring or like component is necessary, and hence the special assembling operation required in the case of using such a component is unnecessary, which leads to cost reductions. Furthermore, since the flexing portions 58 extend in the direction substantially perpendicular to the direction of insertion of the first buckle body 26, the second buckle body 28 is not increased in size in the directions of insertion and withdrawal of the first buckle body 26.

In this embodiment, the first buckle body 26 is deeply inserted within the second buckle body 28 by causing flexing of the flexing portions 58 when separating the first and second buckle bodies 26 and 28. That is, different inserting forces are applied to the first buckle body 26 when coupling the first and second buckle bodies 26 and 28 and when separating these bodies, so that different sensations are experienced during the operations of coupling and separating the buckle bodies.

As has been described in the foregoing, with the buckle according to the invention the second buckle body has the flexing portions formed upon a portion facing the free end of the first buckle body in the direction of insertion during a state of engagement with the first buckle body, and extending in the direction substantially perpendicular to the direction of insertion and withdrawal of the first buckle body and capable of being elastically flexed in the direction of insertion of the first buckle body, the flexing portions serving to restrict the extent of insertion of the first buckle body within the second buckle body so as to locate the first buckle body at a position of engagement with the second buckle body and being flexed so as to locate the first buckle body at a position of disengagement with respect to the second buckle body. Thus, it is possible to reduce the number of components, the cost, and the size of the second buckle body in the direction of insertion and withdrawal of the first buckle body with respect thereto.

Obviously, many modifications and variations of the present invention are possible in light of the above teachings. It is therefore to be understood that within the scope of the appended claims, the present invention may be practiced otherwise than as specifically described herein.

What is claimed is:

1. A push-type buckle, comprising:

a first buckle body having an engaging portion;

a second buckle body having an opening into which said first buckle body is inserted;

a receiving portion provided upon said second buckle body for housing and engaging said engaging portion of said first buckle body upon insertion of said first buckle body into said second buckle body so as to prevent withdrawal of said first buckle body from said second buckle body but permitting further insertion of said first buckle body into said second buckle body;

a movable member provided upon said first buckle body for movement in the direction of insertion into and withdrawl from said second buckle body and functioning to release said engagement defined between said first and second buckle bodies upon further insertion of said first buckle body into said second buckle body from the state of engagement; and elastic flexing portions, formed upon a portion of said receiving portion of said second buckle body facing the insertion end of said first buckle body, extending in a direction perpendicular to the directions of insertion and withdrawal of said first buckle body with respect to said second buckle body and being elastic in the direction of insertion of said first buckle body for engaging said engaging portion of said first buckle body with a first predetermined force in order to prevent insertion of said first buckle body into said second buckle body beyond said, state of engagement, and for defining a second predetermined force against which said first buckle body must be moved from said state of engagement and in said direction of insertion in order to achieve disengagement of said first buckle body from said second buckle body.

2. A buckle as set forth in claim 1, wherein:

said first and second buckle bodies comprise plastic moldings.

3. A buckle as set forth in clam 1, wherein:

said movable member comprises an elongated block transversely disposed with respect to said directions of insertion and withdrawal.

4. A buckle as set forth in claim 3, further comprising:

laterally inwardly extending projections provided upon oppositely disposed sidewall portions of said first buckle body; and groove means defined within opposite sides of said movable block member for receiving said projections of said first buckle body whereby said movable block member is guided in its movement upon said first buckle body along said directions of insertion and withdrawal between first and second limit positions.

5. A buckle as set forth in claim 4, further comprising:

space means defined between said movable block member and said first buckle body, along said directions of insertion and withdrawal, when said movable block member is disposed at either one of said first and second limit positions;

flexible pawl means defined upon said second buckle body for disposition within said space means of said first buckle body when said first buckle body is inserted within said second buckle body, and said movable block member is disposed at said first limit position, so as to achieve said state of engagement between said first and second buckle bodies, said flexible pawl means being removed from said space means by said movable block member as said first buckle body is inserted into said second buckle body beyond said state of engagement in accordance with said second predetermined force, and being engaged with said movable block member as said movable block member moves from said first limit position to said second limit position during withdrawal of said first buckle body from said second buckle body so as to prevent re-engagement of said flexible pawl means within said space means.,

6. A buckle as set forth in claim 1, wherein:

said elastic flexing portions comprise cantilevered fingers projecting inwardly within said second buckle body in opposite directions toward each other from opposite sidewall portions of said second buckle body.

* * * * *